US005542858A

United States Patent [19]

Liao

[11] Patent Number: 5,542,858

[45] Date of Patent: Aug. 6, 1996

[54] CHRISTMAS LIGHT BULB SOCKET

[76] Inventor: Nan W. Liao, 18, Tzu Yu Rd., Hsinchu City, Taiwan

[21] Appl. No.: 287,367

[22] Filed: Aug. 8, 1994

[51] Int. Cl.[6] ..... H01R 13/54

[52] U.S. Cl. ..... 439/419

[58] Field of Search ..... 439/419, 430, 439/658, 340, 425; 362/249

[56] References Cited

U.S. PATENT DOCUMENTS

| | | | |
|---|---|---|---|
| 2,965,875 | 12/1960 | Danesi | 439/419 |
| 3,128,141 | 4/1964 | Krupp | 439/419 |
| 3,597,725 | 8/1971 | Beck | 439/419 |
| 4,382,654 | 5/1983 | Schick | 439/340 X |
| 4,777,573 | 10/1988 | Liao | 439/419 |
| 4,807,098 | 2/1989 | Ahroni | 439/419 X |
| 5,051,877 | 9/1991 | Liao | 439/419 |
| 5,330,368 | 7/1994 | Tsuruzono | 439/419 |
| 5,366,386 | 11/1994 | Liao | 439/419 |
| 5,380,215 | 1/1995 | Huang | 439/430 |

*Primary Examiner*—William Briggs

*Attorney, Agent, or Firm*—Morton J. Rosenberg; David I. Klein

[57] ABSTRACT

A Christmas light bulb socket and wiring arrangement is provided. The light bulb socket includes an insertion structure inside the outer housing of the light bulb socket and two insertable conductor strips that are securely held in place. Any loosening of the conductor strips, which could result in unsound electrical connections or hazardous situations, is prevented by the securement method. Furthermore, the light bulb socket supports all types of wire routing and placement configurations to accommodate Christmas light bulbs connected in series that are displayed to achieve a scintillating illuminative effect.

1 Claim, 16 Drawing Sheets

CHRISTMAS LIGHT BULB SOCKET

BACKGROUND OF THE INVENTION

Conventional Christmas light bulbs wired in series mainly consist of socketed light bulbs mounted in an outer housing and two conductor strips that are pierced into the wires to make electrical contact and achieve the objective of connecting the wires to the light bulbs, wherein after the installation of the conductor strips onto the wires, what frequently occurs is the shortcoming of the conductor strips to shift off center due to insecure fastening. This results in troublesome light bulb installation and, furthermore, may lead to short circuits and bare wire exposure due to the bending of the conductor strips as well as numerous instances of the conductor strips dropping off the wires. Furthermore, in order to be displayed at intervals to produce a scintillating illuminative effect, conventional Christmas light bulbs utilize the sharp pointed conductor strips for mounting at different positions to accommodate the piercing of the wires under differing circumstances, such as connecting at opposite angles, to facilitate the arrangement of a scintillating array. However, this operation requires changing the position of each conductor strip and the wires which, furthermore, involves attention to the ordering of each light bulb tip and naturally leads to uneconomical and impractical results.

The primary objective of the invention herein is to provide a kind of Christmas light bulb series wiring and improved structure light bulb socket, wherein the conductor strips and the light bulb socket are fastened together through an insertion structure that supports firm fastening with absolutely no loosening, thereby ensuring that the light bulbs remain firmly in position and in a state of sound electrical contact with the wire.

The secondary objective of the invention herein is to provides for main wires with numerous metal strands such that the sharp contact points of the conductor strips inserted into the light bulb socket can be individually pierced into the additional conductive paths of the main wires to increase control over the intervals of the scintillating array.

The brief description of the drawings and the detailed description of the invention herein introducing the unique characteristics and functions are attached below.

DETAILED DESCRIPTION OF THE INVENTION

Figure 1:
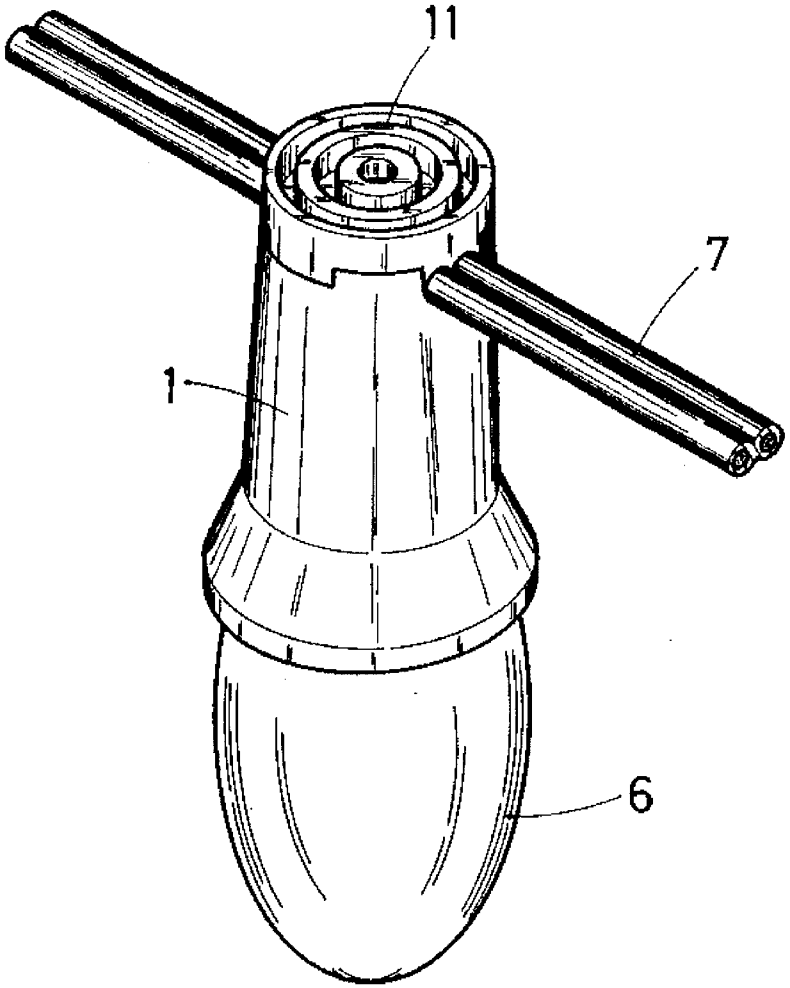
FIG. 1 is an isometric drawing of the invention herein, depicting one fixture in a series of Christmas light bulbs.
Figure 2:
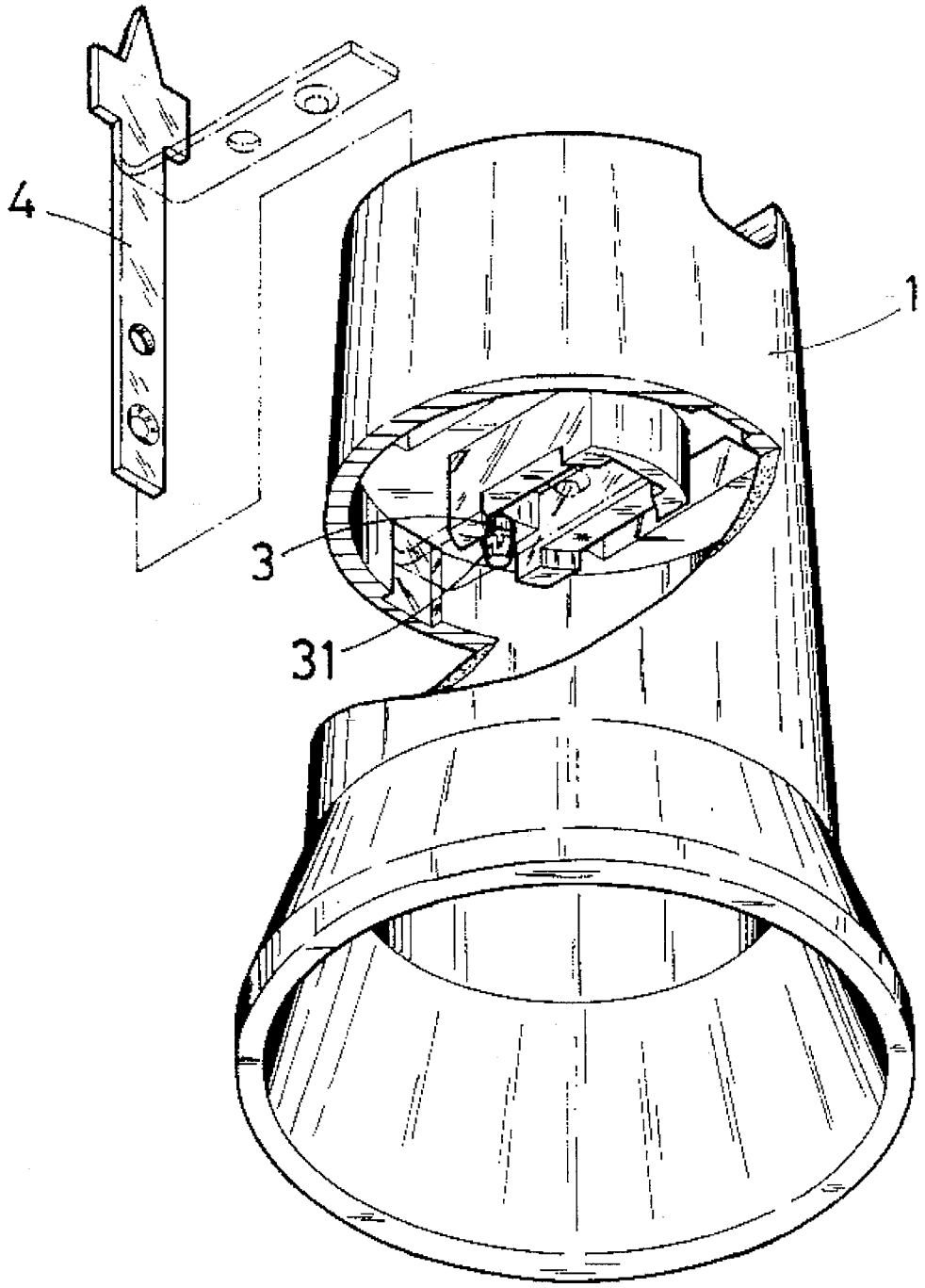
FIGS. 2 and 2A are two isometric drawings of the socket and outer housing of the invention herein, with a partial cross-sectional inset.
Figure 2A:
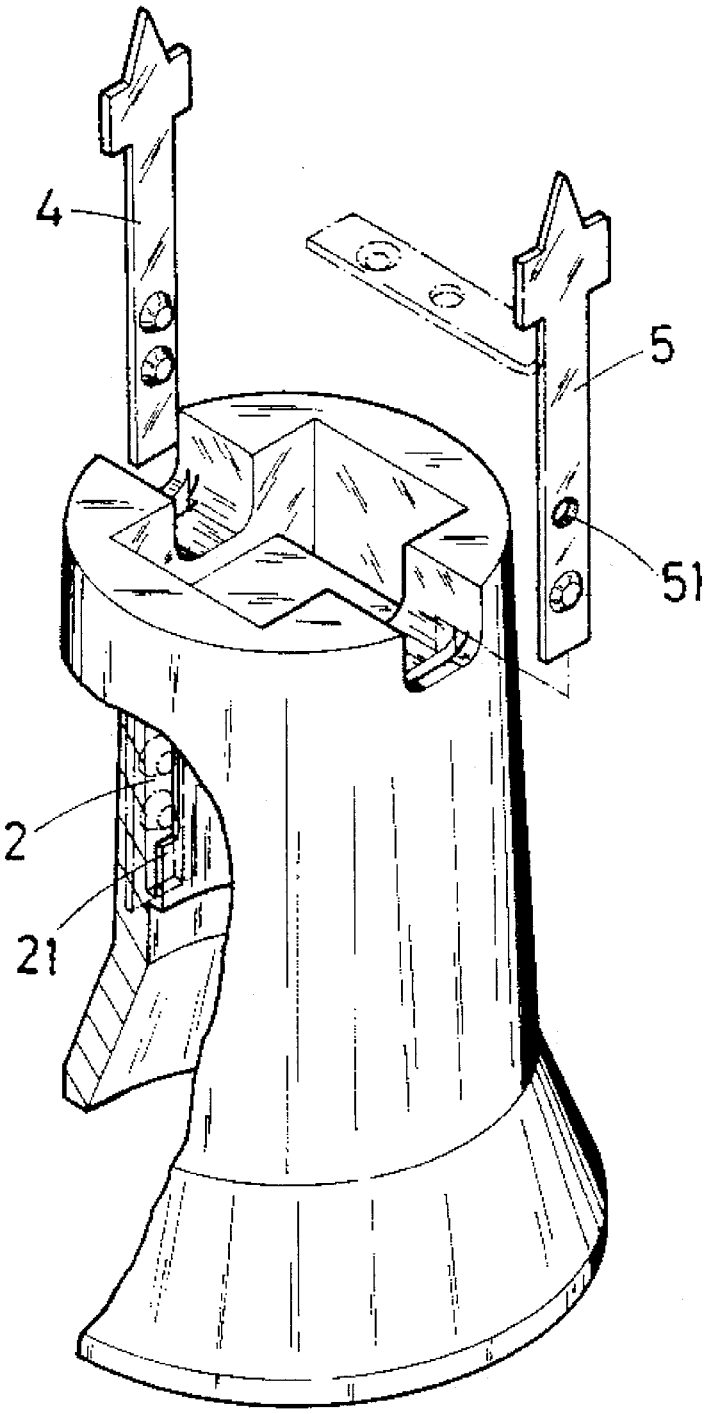
Figure 3:
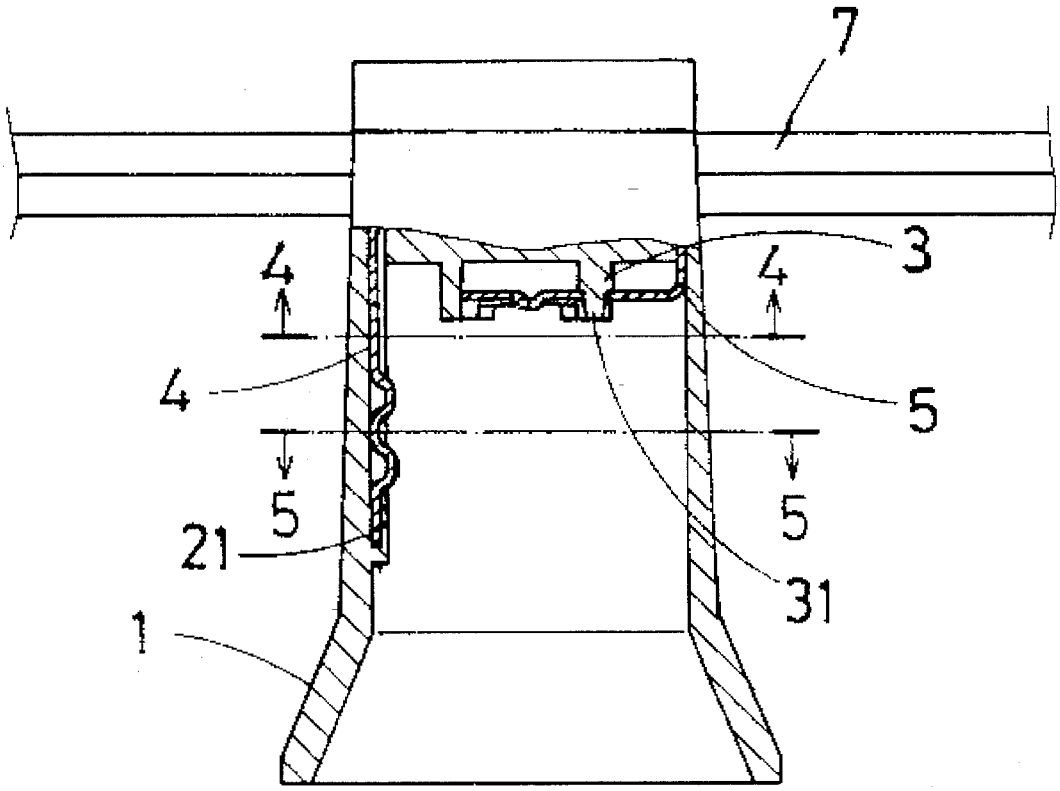
FIG. 3 is a cross-sectional drawing of the invention herein illustrating assembly details.
Figure 4:
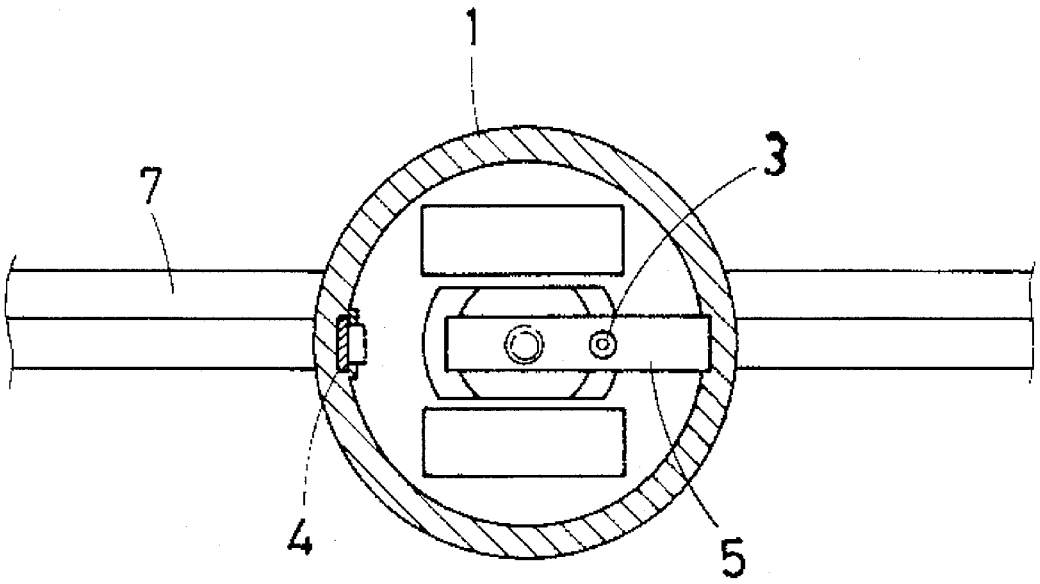
FIG. 4 is a cross-sectional drawing of 4—4 in FIG. 3.
Figure 5:
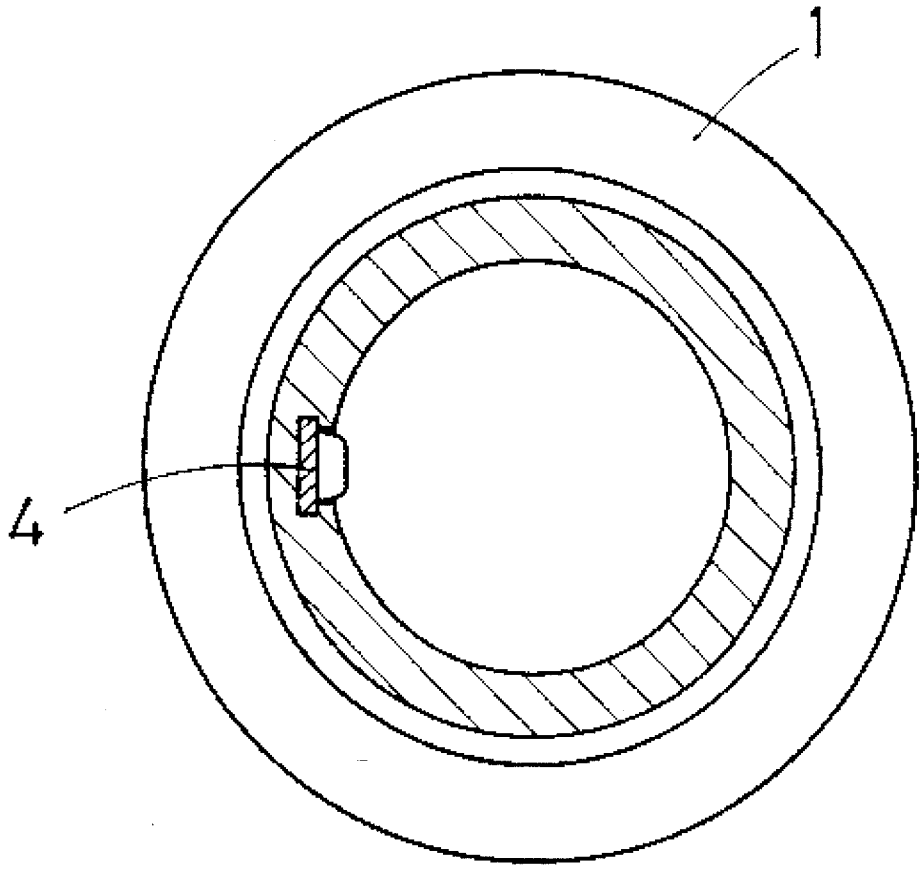
FIG. 5 is a cross-sectional drawing of 5—5 in FIG. 3.
Figure 6:
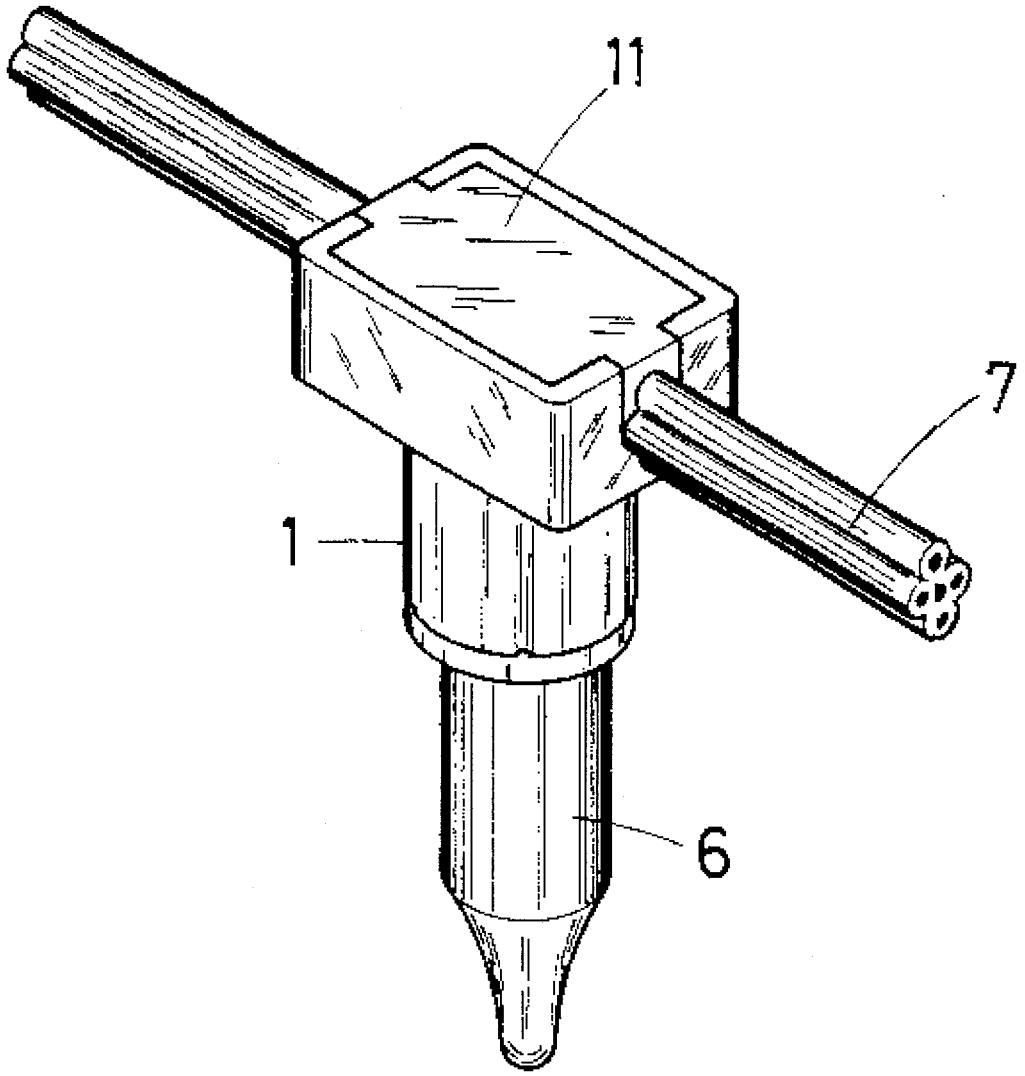
FIG. 6 is an isometric drawing of another embodiment of the invention herein, depicting one fixture in a series of Christmas light bulbs.
Figure 6A:
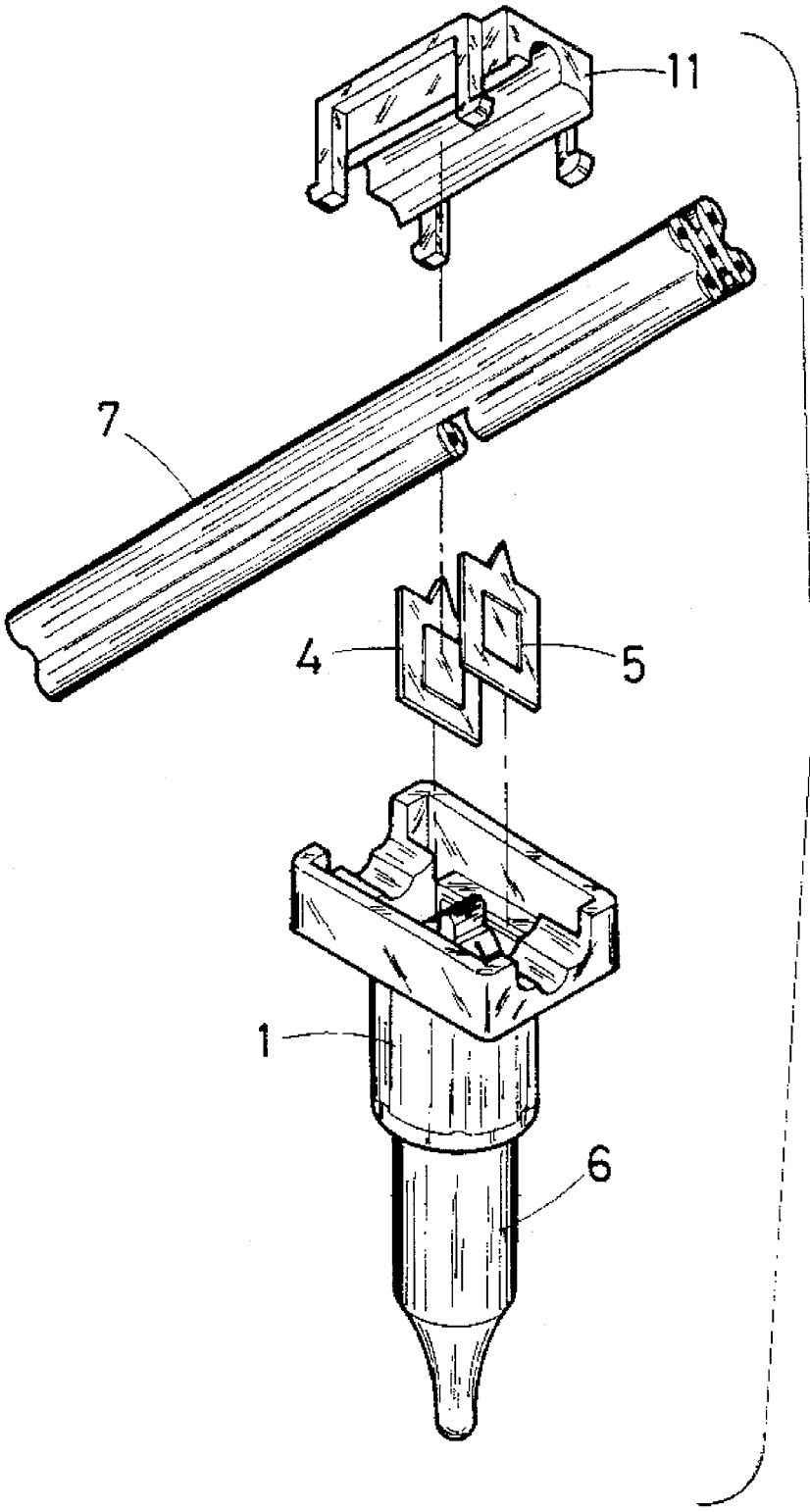
FIGS. 6A and 6B are two exploded perspective views according to FIG. 6.
Figure 6B:
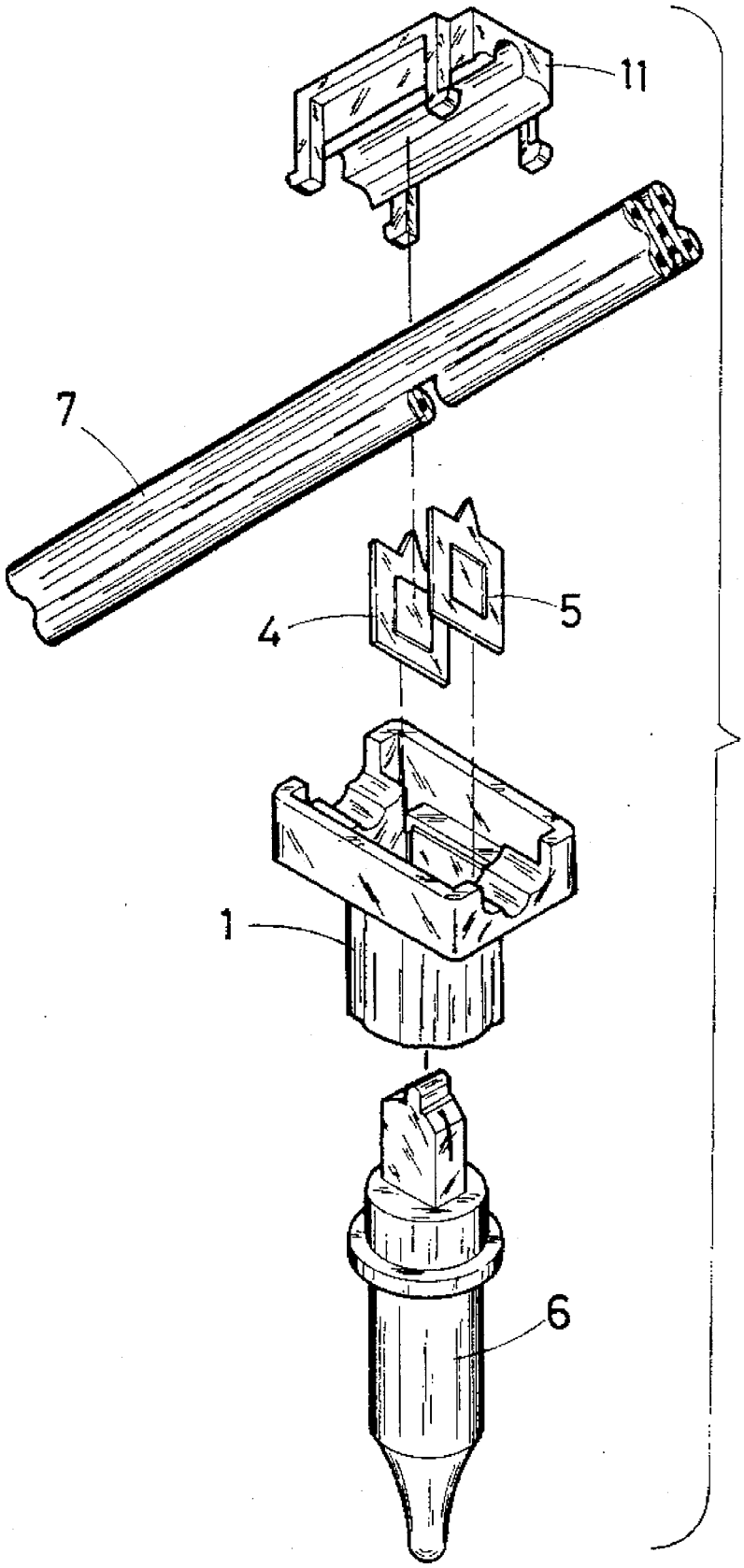

As indicated in FIG. 1, FIGS. 2, 2A, and FIG. 3, the invention herein is mainly comprised of an outer housing (1) with an insertion slot (2) built into the side; the insertion slot (2) has a forward retaining wall (21) and when the conductor strip (4) is vertically inserted into the insertion slot (2), the end of the conductor strip (4) is interlocked by the forward retaining wall (21), thereby effectively forming a firm insertion that will not loosen; furthermore, there is a conical insertion pin (3) with a lateral hooked segment (31) positioned inside the upper portion of the outer housing (1), opposite to which is another conductor strip (5) with an interlocking hole (51) in the center, and when the aforesaid conductor strip (5) is inserted into the outer housing (1) and after the end penetrates horizontally, the interlocking hole (51) latches onto the conical insertion pin (3) and is kept in place by the lateral hooked segment (31), which ensures that the conductor strip (5) is firmly maintained in position; as indicated in FIG. 4 and FIG. 5, the two aforesaid two conductor strips (4) and (5) are tightly fastened to the outer housing (1).

Since the aforementioned two conductor strips (4) and (5) are based on the unique design of the invention herein, the outer housing (1) can be attached securely onto the side of the wires, which effectively provides for the convenient assembly of the light bulb (6), furthermore, the light bulb (6) can be kept in a state of electrical connection through the two conductor strips (4) and (5) to the main wires (7) and fastened in contact by the upper cover (11), the pressure of which pierces the conductor strips (4) and (5) into the main wires (7), thereby achieving electrical continuity, as indicated in FIGS. 6, 6A, 6B, and FIGS. 7, 7A.

Figure 7:
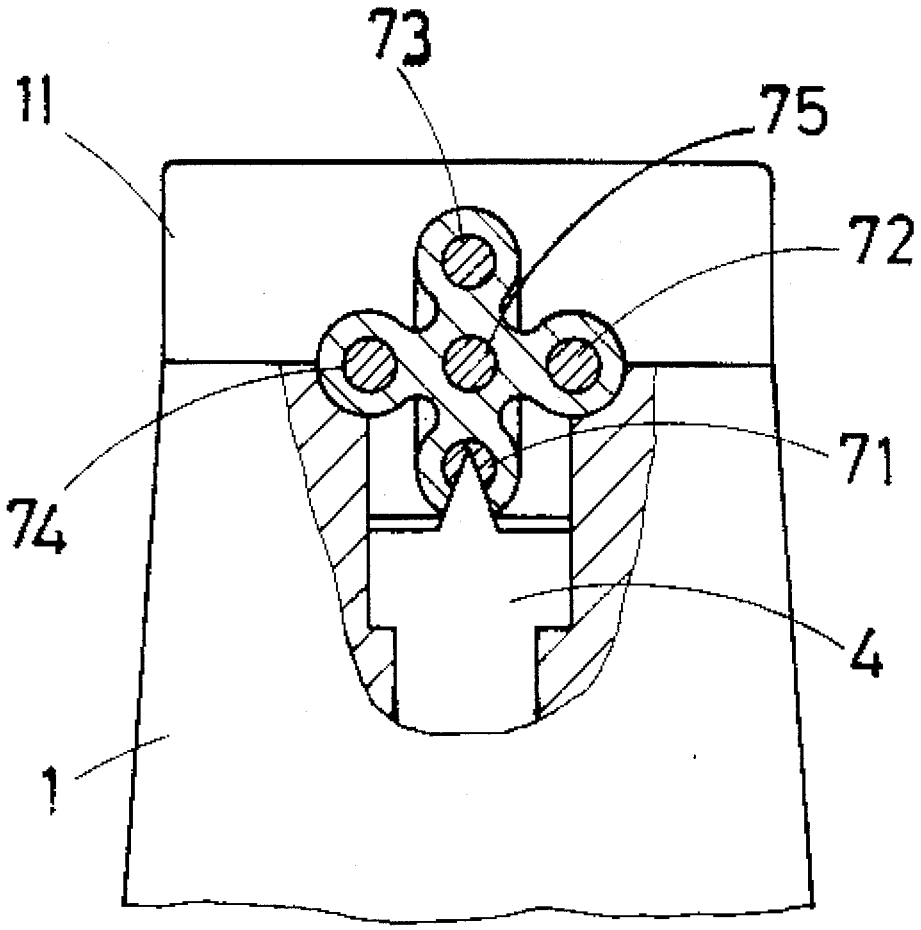
FIG. 7 and 7A are cross-sectional drawings of the invention herein detailing the conductor strip piercing into the wire.
Figure 7A:
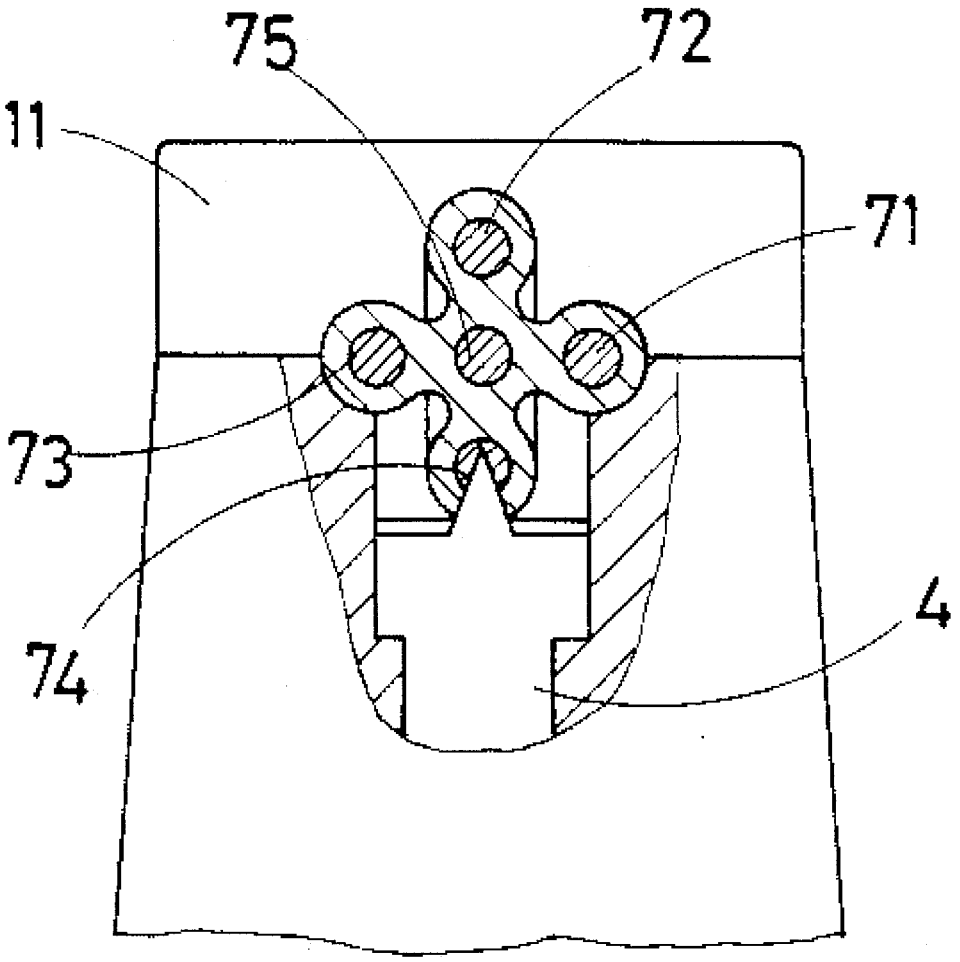
Figure 8:
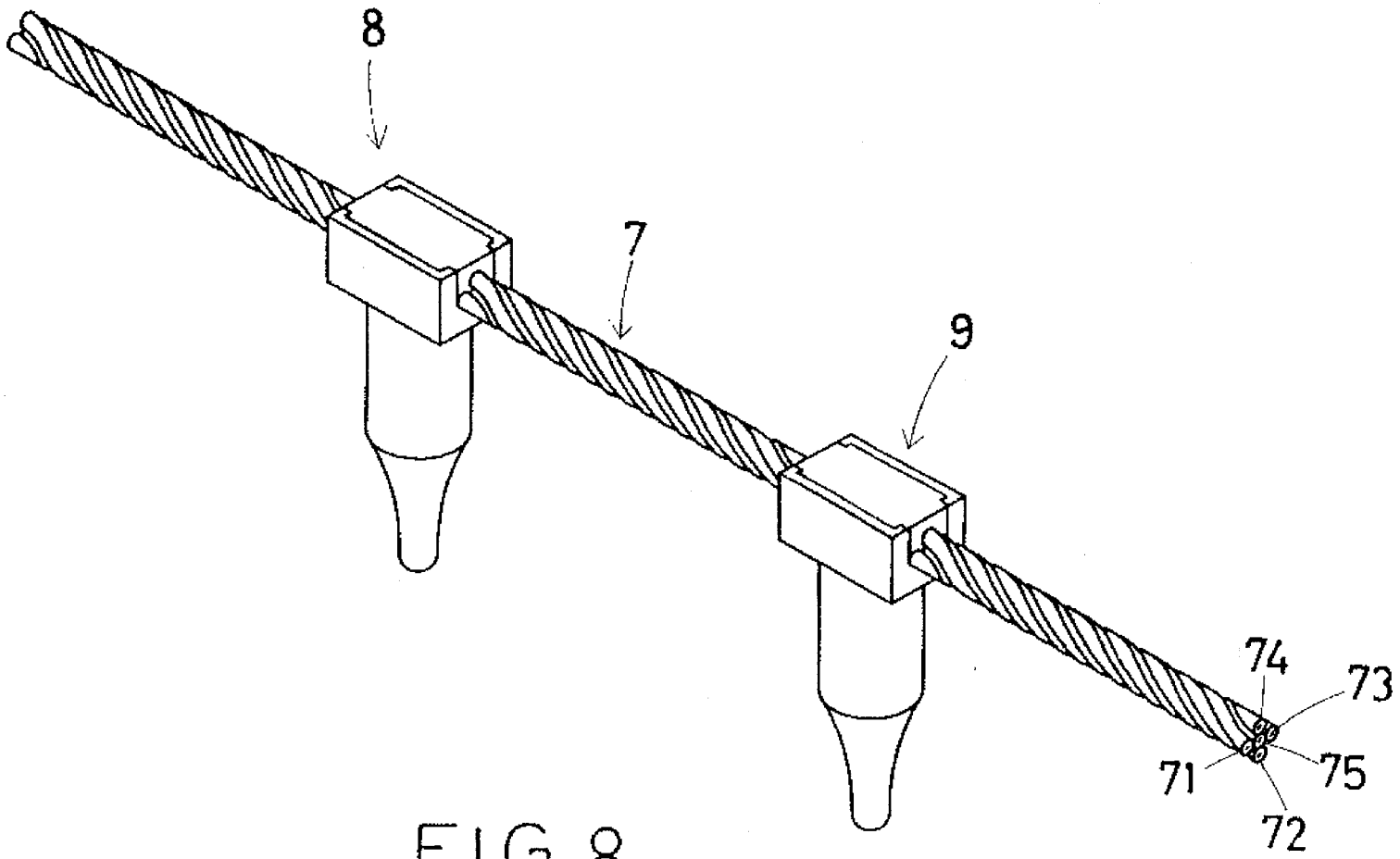
FIG. 8 is an isometric drawing of the preferred embodiment of the invention herein.
Figure 9:
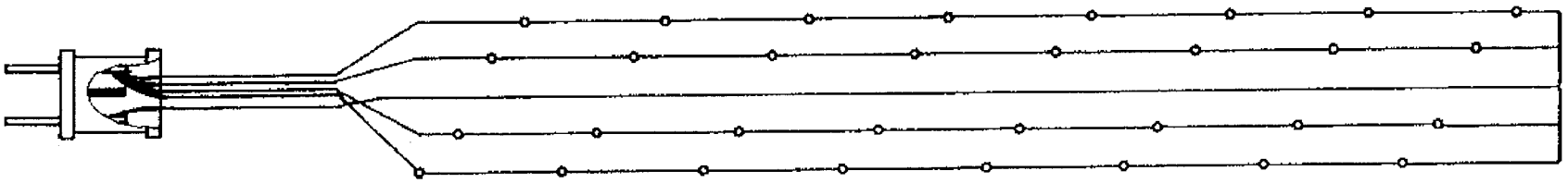
FIG. 9 is a schematic drawing of the preferred embodiment of the invention herein.
Figure 10:
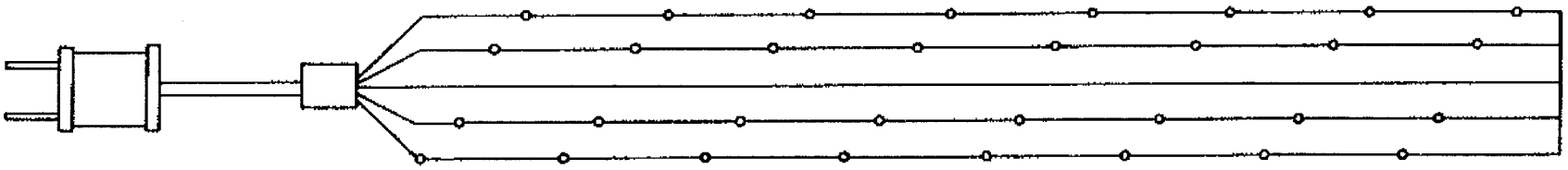
FIG. 10 is a schematic drawing of the preferred embodiment of the invention herein.

Another unique feature of the invention herein is the design configuration of the main wires (7) and the conductor strips (4) and (5) which, as indicated in FIGS. 7, 7A and FIG. 8, consists of the five metal strands (71), (72), (73), (74) and (75), wherein the center strand (75) can be of one polarity (negative polarity) , while the other metal strands (71), (72), (73) and (74) can be of another polarity (ground or positive polarity) to achieve a complete electrical circuit, thereby enabling light bulb sockets to be pierced into the respective different metal strands and added into the existent circuit, as in the example of the first light bulb-socket fixture (8) pierced into the metal strand (71) and the second light bulb-socket fixture (9) pierced into the metal strand (72), wherein an entire series of light bulb-socket fixtures can be connected to a controller or one controller connected to each light bulb-socket fixture to achieve a scintillating effect and, as indicated in FIG. 9 and FIG. 10, it is not necessary to discriminate between the different conductor strips and main wires when piercing the light bulb socket fixtures into position.

Figure 11:
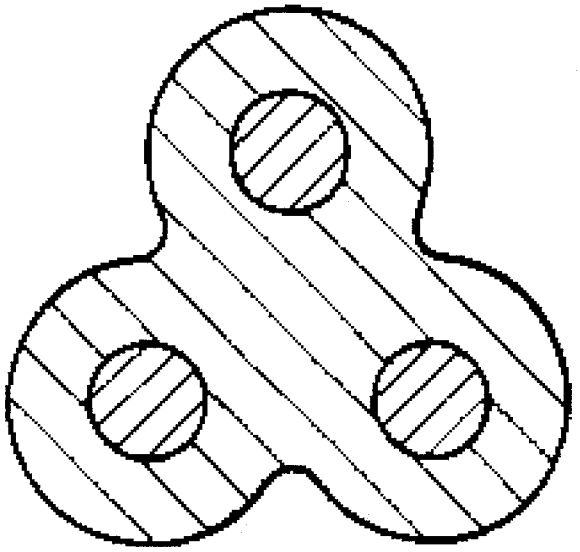
FIG. 11 is a cross-sectional drawing of the different conductor strands of the invention herein.
Figure 12:
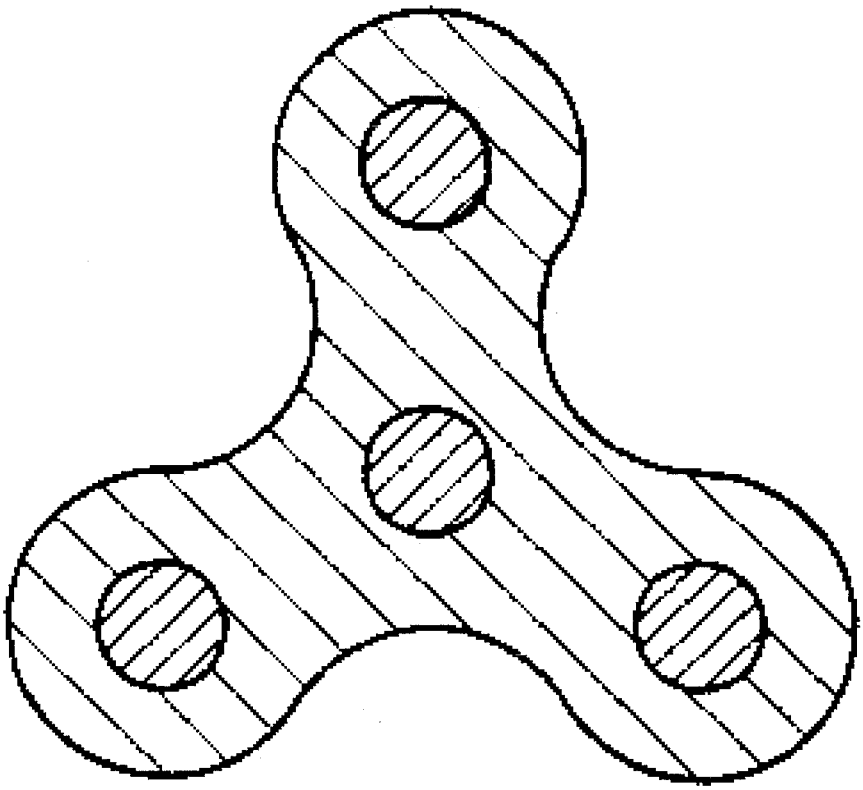
FIG. 12 is a cross-sectional drawing of the different conductor strands of the invention herein.

As indicated in FIG. 11 and FIG. 12, the invention herein can utilize main wires having different shapes, including irregular or unsymmetrical shapes, for the simple mounting of the Christmas light bulbs wired in series and, furthermore, the number of metal strands of the main wires can be increased or decreased to facilitate changes in decorative appearance or arrangement, and all of the aforementioned features are included within the scope of the claims relating to the invention herein.

What is claimed is:

1. An improved Christmas light bulb socket for coupling with a pair of wires, comprising:

an outer housing having a longitudinally extended cylindrical wall, said outer housing having an open first end for receiving a light bulb in an interior space defined by said cylindrical wall and a rear end wall of said outer housing, said rear end wall having an outer surface defining a second end of said outer housing, said cylindrical wall having a pair of longitudinally directed insertion slots formed on opposing sides thereof and a respective pair of openings formed in opposing interior sides of said cylindrical wall providing open communication between said pair of insertion slots and said interior space, said outer housing having a conically shaped insertion pin extending longitudinally into said interior space from said rear end wall, said conically shaped insertion pin having a lateral hooked segment formed adjacent a distal end thereof;

a first conductor strip having a pointed first end for piercing a respective one of the pair of wires, said first conductor strip having a second end insertable into a first of said pair of insertion slots for interlocking engagement with a respective one of said pair of openings and contact with one contact of a light bulb;

a second conductor strip having a pointed first end for piercing a respective one of the pair of wires and a through bore formed centrally therein, said second conductor strip having a second end insertable into a second of said pair of insertion slots for passage into said interior space through a respective one of said pair of openings and transverse displacement of said second end for securement to said rear end wall by engagement of said conically shaped insertion pin with said through bore, said second end of said second conductor strip being lockingly engaged with said conically shaped insertion pin by said lateral hooked segment; and, an upper cover coupled to said second end of said outer housing for securing the pair of wires therebetween.

* * * * *